US005753084A

United States Patent [19]

Bubik et al.

[11] Patent Number: 5,753,084

[45] Date of Patent: May 19, 1998

[54] ELONGATED GAP PRESS WITH ADJUSTABLE LENGTH

[75] Inventors: Alfred Bubik; Joachim Henssler, both of Ravensburg; Harald Hess, Grunkraut; Peter Mirsberger, Baienfurt; Wolfgang Schuwerk, Kisslegg; Christian Steger, Constance; Elmer Weisshuhn, Vogt; Ulrich Wieland, Berg, all of Germany

[73] Assignee: Voith Sulzer Papiermaschinen GmbH, Heidenheim, Germany

[21] Appl. No.: 829,145

[22] Filed: Mar. 31, 1997

Related U.S. Application Data

[63] Continuation of Ser. No. 498,784, Jul. 5, 1995, abandoned.

[30] Foreign Application Priority Data

Jul. 6, 1994 [DE] Germany ..... 44 23 694.8

[51] Int. Cl.[6] ..... D21F 3/02

[52] U.S. Cl. ..... 162/358.3; 162/361; 100/153

[58] Field of Search ..... 162/358.3, 361; 492/7; 100/153, 154

[56] References Cited

U.S. PATENT DOCUMENTS

| | | | |
|---|---|---|---|
| Re. 31,923 | 6/1985 | Justus et al. | 162/358.3 |
| 4,328,744 | 5/1982 | Pav et al. | 492/7 |
| 4,425,190 | 1/1984 | Cronin | 162/358.3 |
| 4,556,454 | 12/1985 | Dahl et al. | 162/358.3 |
| 4,568,423 | 2/1986 | Laapotti | 162/358.3 |
| 4,570,314 | 2/1986 | Holik et al. | 162/358.3 |
| 4,705,602 | 11/1987 | Dahl | 162/358.3 |
| 4,713,147 | 12/1987 | Saarinen | 162/358.3 |
| 4,852,229 | 8/1989 | Crouse | 492/7 |
| 4,973,384 | 11/1990 | Crouse et al. | 162/358.3 |

FOREIGN PATENT DOCUMENTS

| | | | |
|---|---|---|---|
| 0345500 | 12/1989 | European Pat. Off. . | |
| 218918 | 2/1985 | German Dem. Rep. | 162/358.3 |
| 929773 | 5/1982 | U.S.S.R. | 162/358.3 |

*Primary Examiner*—Karen M. Hastings
*Attorney, Agent, or Firm*—Greenblum & Bernstein P.L.C.

[57] ABSTRACT

This invention pertains to an elongated gap or extended nip press comprised of two pressing elements whose pressing areas are pressed against each other, wherein each of the press areas is formed of a band-shaped jacket element, with the jacket element moving around carriers and being supported by at least one support element, wherein a change of the length of the press gap or nip and/or of the pressure distribution or pattern in the press gap is accomplished in that the portions of the press elements that form the support surfaces and/or that the support elements of at least one of the pressing elements are displaceable in or against the direction of rotation of the respective jacket element.

21 Claims, 1 Drawing Sheet

ELONGATED GAP PRESS WITH ADJUSTABLE LENGTH

CROSS REFERENCE TO RELATED APPLICATIONS

This application is a continuation of application Ser. No. 08/498,784, filed Jul. 5, 1995, now abandoned.

This application claims the priority of German Patent Application No. DE P 44 23 694.8, filed Jul. 6, 1994, the disclosure of which is incorporated herein by reference in its entirety.

BACKGROUND OF THE INVENTION

1. Field of the Invention

The invention pertains to an elongated gap or extended nip press comprised of two pressing elements, with the pressing elements including pressing areas, wherein the pressing areas are pressed against each other, with each of the pressing areas being formed of a jacket element, with the jacket elements moving around carriers and being supported by at least one support element, with such presses being utilized for the production or treatment of band or web shaped materials, particularly fiber webs.

2. Discussion of the Background of the Invention and Material Information

During the production or treatment of web shaped material it may become necessary, for example during the dehydration of fiber webs, that the length of the press gap or nip and/or the pressure distribution within the press gap be variable for the adaption thereof to changing properties of the material.

European Patent Publication EPS 0 345 500 sets forth a solution in which the pressure distribution within the press gap is influenced via two cylinder-piston units that effect a pressing shoe and are mounted in tandem in the circumferential direction of a press roll. The solution is however too expensive and is not suited for changing the length of the press gap.

The invention thus has the task or object to produce an elongated gap press which permits, at low expenditure, a change in the length of the press gap and/or the pressure distribution or pattern within the press gap.

SUMMARY OF THE INVENTION

This task or object was solved or achieved in accordance with the invention via an elongated gap press having an extended nip, comprised of two pressing elements, with the pressing elements including pressing areas, wherein the pressing areas are pressed against each other, with each of the pressing areas being formed of a jacket element, with the jacket elements moving around carriers and being supported by at least one support element, wherein the support surfaces that are formed by portions of the support elements and/or the support elements of at least one pressing element, are displaceable in or against the direction of rotation of the respective jacket element.

In another embodiment of the elongated gap press of this invention, the jacket elements of both pressing elements are comprised of a flexible material and preferably have flat pressing areas.

In a further embodiment of the elongated gap press of this invention, the support surfaces of the support elements of one of the pressing elements, in the direction of rotation of the jacket elements, are smaller in size than those of the opposed support elements of the other one of the pressing elements, with only the portions of the support elements that form the support surfaces of one of the support elements being displaceable in or against the direction of rotation of the respective jacket element for the purpose of influencing the pressure profile in the press nip.

In yet another embodiment of the elongated gap press of this invention, the support surfaces of the support elements of both pressing elements are of about the same size and wherein the support surfaces that are formed by the portions of the support elements and/or the support elements of at least one pressing element, are displaceable in or against the direction of rotation of the respective jacket element, preferably for changing the length of the press nip.

In yet a further embodiment of the elongated gap press of this invention one of the pressing elements includes a concave press area, with the jacket element of the one of the pressing elements being comprised of a flexible material, and wherein the jacket element of the other one of the pressing elements being comprised of a rigid material and being cylindrically shaped, with the support elements of the cylindrical pressing elements being preferably displaceable, via an angular motion of the pressing element, in or against the direction of rotation of the rigid jacket element.

Since the portions of the support elements that form the support surfaces and/or the support elements themselves of at least one pressing element are displaceable in or against the circumferential direction of the corresponding jacket element, there exists a relatively simple possibility for accomplishing the noted task. Since, depending on whether the support elements or the portions thereof that form the support surfaces are changeable during operation, with reference to their location or position relative to the opposing support elements, a choice must be made as to the adjusting devices required so as to achieve these changes.

In case the support elements are moved as a whole, care must be taken that the resulting moments can be absorbed.

Should, for example, the support elements be moved as a whole, it is recommended that this be accomplished via a suitable location or position change of each of the carriers.

While adjustable connections are sufficient to assure the changeability of the position of an element at rest, electrical or hydraulic adjusting devices are more suitable for changes during actual operation.

In case the jacket elements of both of the pressing elements are comprised of a flexible material it is advantageous if the pressing elements, for the protection of the jacket elements relative to the deformation thereof, have even or flat pressing areas or surfaces. These can, however, also be slightly curved wherein, in all instances, a rounding off or curvature of the inlet and outlet regions of the pressing surfaces is recommended.

If the support surfaces of the support elements of a pressing element, in the direction of rotation of the jacket element, are shorter than those of the opposed support elements of the other pressing element, it is logical, for changing the pressure profile within the press gap, if only the portions of the support elements of a pressing element that form the support surfaces are displaced in or against the direction of rotation of the respective jacket element, while the contact pressure elements of the support elements that act on the opposing press element, remain in place. If, however the support surfaces of the opposing support elements of both pressing elements are of about the same size, for a change in the length of the press gap it is possible with at least one pressing element that the portions of the support elements that form the support surfaces, and/or that the support elements themselves, that is with their pressure elements, are displaceable in or against the direction of rotation of the corresponding jacket element. If, in contrast thereto, one of the pressing element has a concave pressing surface, and if the jacket element of this pressing element is comprised of a flexible material and the jacket element of the other pressing element is comprised of a rigid or stiff material and is also of cylindrical shape, then a position or location change of the support elements of the cylindrical press element can be advantageously achieved via the angular displacement of the carrier of this press element in or against the direction of rotation of the rigid jacket element. The rigid jacket element also permits a press gap to be formed with the entire concave press surface, even when the support surface of the cylindrical press element does not cover the entire concave press surface.

BRIEF DESCRIPTION OF THE DRAWINGS

The invention which will be described with reference to three embodiments thereof will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS AND BEST MODE

Figure 1:
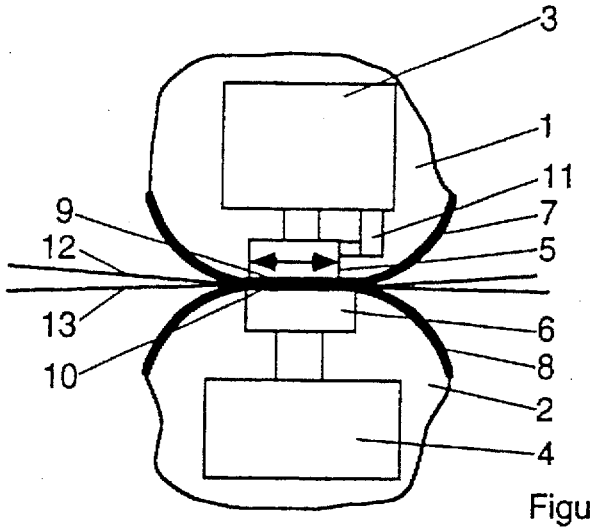
FIG. 1 is a partial sectional view of one embodiment of the elongated gap or extended nip press of this invention.

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

The elongated gap or extended nip presses of this invention are comprised of two pressing elements 1 and 2, whose pressing areas are pressed against each other, wherein each of the pressing areas is formed of a band-shaped covering, shell or jacket element 7 and 8, with the jacket elements moving or rotating around and being supported by carriers 3 and 4. Through the press gap, that is formed as a result thereof, in addition to a material web or band 12, a dewatering or dehydration web or band 13, can also be conveyed.

Figure 2:
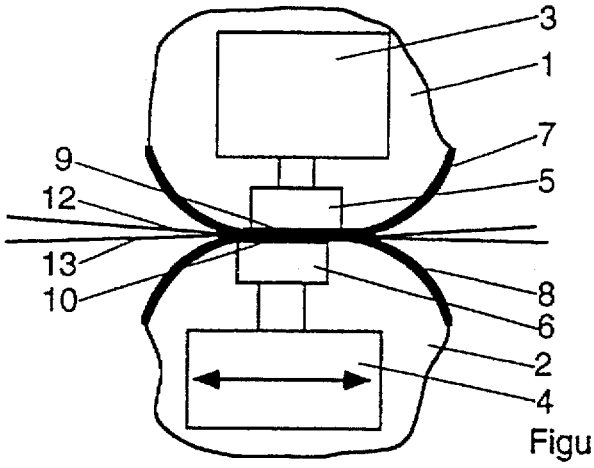
FIG. 2 is also a partial sectional view of another embodiment of the elongated gap or extended nip press of this invention.

As per FIGS. 1 and 2, pressing elements 1 and 2 have flat or even pressing areas and the jacket elements 7 and 8 of both pressing elements 1 and 2 are comprised of a flexible material.

While, in the embodiment of FIG. 1, the single integral portion of support element 5 (depicted in the exemplary illustration as a single integral element) of pressing element 1 that forms the support surface 9, is displaceable, via an hydraulically actuated adjusting device 11 for example, in or against the circumferential direction of jacket element 7, the displacement of the entire support element 6, of the embodiment illustrated in FIG. 2, is accomplished via a suitable position or location change of carrier 4 of this press element 2.

If, as in FIG. 1, the support surface 9 of support elements 5 of pressing element 1, in the direction of rotation of jacket element 7, is smaller than that of the opposed support elements 6 of the other pressing element 2 (depicted in the exemplary illustration as a single integral element), then it is surely logical that the pressure profile of the press gap is changed via the displacement of the portion of support element 5 that forms support surface 9. Since, due to the flexibility of the material of jacket elements 7 and 8, a press gap is only formed in the region where support elements 5 and 6 are opposite to each other, it is only natural that during a sufficient displacement of support element 5 or of the portion of support element 5 that forms support surface 9, it is also possible, as shown in FIG. 2, to reduce the press gap.

In the example or embodiment of FIG. 2, the single integral support surfaces 9 and 10 of opposing support elements 5 and 6 of both pressing elements 1 and 2 are of about the same size, so that, already in contrast to FIG. 1, only a minimal displacement of the portion of support element 6 that forms support surface 10 or of the entire support element 6, already affects the length of the press gap.

Figure 3:
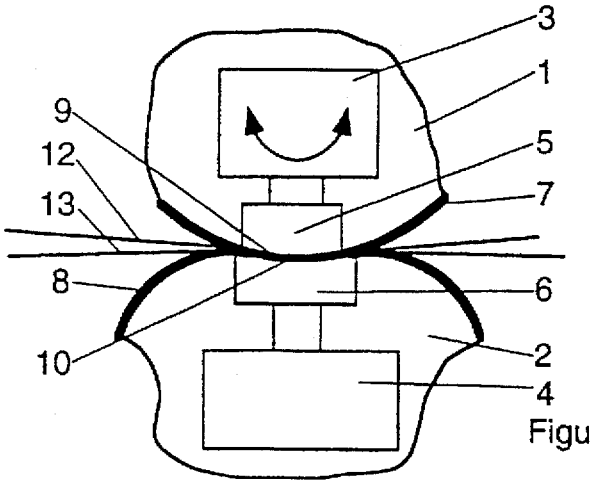
FIG. 3 is a further partial sectional view of a further embodiment of the elongated gap or extended nip press of this invention.

Deviating from the structure described to this point, the jacket element 8, of FIG. 3, is comprised of but one pressing element 2 of a flexible material, with the other jacket element 7 being comprised of a rigid material. Commensurately, flexible pressing element (e.g., a press shoe) 2 has a concave pressing area and the jacket element (e.g., a press shoe) 7 of the other pressing element 1 has a cylindrical shape or form. In order to displace support elements 5 of the cylindrical pressing element 1, in or against the direction of rotation, it is sufficient to suitably angularly displace carrier 3. Due to the rigidity or stiffness of jacket element 7 only the pressure profile but not the length of the press gap can be influenced. It is of course also possible, in this embodiment to only displace the portion of support element 5 that forms support surface 9.

In all of the described embodiments, pressing elements 1 and 2 can utilize only one support element 5 or 6 or several support elements 5 or 6 arranged next to each other.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. An elongated gap press having an extended nip press zone, comprising:

two pressing elements, with each pressing element including a pressing area;

the pressing areas being pressable against each other to form the extended nip, and each of the pressing areas being formed of a jacket element and at least one support element supporting the jacket element;

each at least one support element comprising a single integral support surface contacting an interior of an associated jacket element;

and at least one of the support surfaces being displaceable in at least one of in and against a direction of rotation of the associated jacket element to adjust a length of the extended nip press zone.

2. The elongated gap press of claim 1, the jacket elements of each pressing element comprising a flexible material and a flat pressing area.

3. The elongated gap press of claim 1, wherein the jacket elements of both pressing elements are comprised of a flexible material.

4. The elongated gap press of claim 1, the support surface of a first of the two pressing elements being smaller in size than the support surface of a second of the two pressing elements; and the displacement of the at least one support surface influencing a pressure profile in the press nip.

5. The elongated gap press of claim 2, the support surface of a first of the two pressing elements being smaller in size than the support surface of a second of the two pressing elements; and the displacement of the at least one support surface influencing a pressure profile in the press nip.

6. The elongated gap press of claim 3, the support surface of a first of the two pressing elements being smaller in size than the support surface of a second of the two pressing elements; and the displacement of the at least one support surface influencing a pressure profile in the press nip.

7. The elongated gap press of claim 1, the support surface of each pressing element is about a same size.

8. The elongated gap press of claim 2, the support surface of each pressing element is about a same size.

9. The elongated gap press of claim 3, the support surface of each pressing element is about a same size.

10. The elongated gap press of claim 1, a first of the two pressing elements comprising a concave press area;

the jacket element associated with the first pressing element comprising a flexible material;

the jacket element associated with a second of the two pressing elements comprising a rigid material and a cylindrically shape;

the at least one support element forming the concave pressing area being displaceable, via an angular motion, in at least one of in and against the direction of rotation of the rigid jacket element.

11. The elongated press gap according to claim 1, the single integral surface being solid.

12. An elongated gap press having an extended nip press zone comprising:

a first roll comprising a rotating roll jacket and at least one press shoe supporting a portion of the rotating roll jacket;

a second roll;

the extended nip formed between the second roll and the portion of the rotating roll jacket supported by the at least one press shoe;

the at least one press shoe being a single integral element displaceable in at least one of in and against a direction of rotation of the rotating roll jacket to adjust a length of the extended nip press zone.

13. The elongated gap press according to claim 12, further comprising a carrier supporting the at least one press shoe.

14. The elongated gap press according to claim 13, wherein the at least one press shoe moves relative to the carrier during displacement.

15. The elongated gap press according to claim 13, wherein the at least one press shoe is fixed in relation to the carrier during displacement.

16. The elongated gap press according to claim 12, the at least one press shoe comprising a substantially flat support surface supporting the portion of rotating jacket;

the second roll comprising a rotating jacket and at least one press shoe comprising a substantially flat support surface supporting a portion of the rotating jacket; and the extended nip formed between the substantially flat support surfaces of the first and second rolls.

17. The elongated gap press according to claim 16, further comprising a carrier associated with the first roll supporting the at least one press shoe;

the at least one press shoe of the first roll being one of movable relative to and immobile relative to the carrier during displacement.

18. The elongated gap press according to claim 12, the at least one press shoe being angularly displaceable in at least one of in and against a direction of rotation of the rotating roll jacket.

19. The elongated gap press according to claim 18, further comprising a carrier associated with the at least one press shoe;

the at least one press shoe being immobile relative to the carrier during displacement.

20. The elongated gap press according to claim 12, wherein the displacement of the at least one press shoe in one of in and against the direction of rotation adjusts a pressure profile and the length of the extended nip.

21. The elongated press gap according to claim 12, the single integral element being solid.

* * * * *